US007896654B2

(12) United States Patent
Zheng

(10) Patent No.: US 7,896,654 B2
(45) Date of Patent: Mar. 1, 2011

(54) ASYMPTOTIC HEAD AND SOCKET ELECTRICAL CONNECTION

(75) Inventor: Zhe Zheng, Zhejiang (CN)

(73) Assignee: Gulifa Group Co., Ltd., Zhejiang (CN)

( * ) Notice: Subject to any disclaimer, the term of this patent is extended or adjusted under 35 U.S.C. 154(b) by 0 days.

(21) Appl. No.: 12/666,419

(22) PCT Filed: Jul. 15, 2008

(86) PCT No.: PCT/CN2008/001319

§ 371 (c)(1),
(2), (4) Date: Dec. 23, 2009

(87) PCT Pub. No.: WO2009/009958

PCT Pub. Date: Jan. 22, 2009

(65) Prior Publication Data

US 2010/0144163 A1 Jun. 10, 2010

(30) Foreign Application Priority Data

Jul. 16, 2007 (CN) ..... 2007 1 0130306

(51) Int. Cl.
*H01R 39/00* (2006.01)

(52) U.S. Cl. ..... 439/8
(58) Field of Classification Search ..... 439/8
See application file for complete search history.

(56) References Cited

FOREIGN PATENT DOCUMENTS

| | | | |
|---|---|---|---|
| CN | 2391348 | Y | 8/2000 |
| CN | 2746572 | Y | 12/2005 |
| CN | 101098051 | A | 1/2008 |
| DE | 10026667 | A1 | 12/2001 |
| WO | WO9828820 | A1 | 7/1998 |

*Primary Examiner*—Edwin A. Leon
*Assistant Examiner*—Vanessa Girardi
(74) *Attorney, Agent, or Firm*—Lathrop & Clark LLP

(57) ABSTRACT

An electric connection structure includes a metal element (1) with an axle cavity and a metal element (2) with an axle head. The cross section edges of the hinge faces between the axle cavity and the axle head are in gradual spiral line type. As both the metal elements (1, 2) have larger corner, the hinge faces have larger space which will disappear when the metal elements rotate to be approximately horizontal, and the axle head and the axle cavity will attain compression force to be tightly combined in continuous rotation of the metal elements so as to have a large electric contact face, tight contact, non-loosen, and free maintenance.

4 Claims, 2 Drawing Sheets

ASYMPTOTIC HEAD AND SOCKET ELECTRICAL CONNECTION

TECHNICAL FIELD

The present invention involves an electric connection method in the field of electric connection in power systems that is named an "asymptotic spiral electric connection" according to the principles of its features, and this connection method is suitable for connection in high current devices or between the conducting wires in the power system, especially the connection that is required to make and break frequently.

BACKGROUND TECHNOLOGY

There are a variety of electric connection methods in existing power systems, and the most commonly used is the crimping connection, such as connecting tubes, where the crimping tool is used to deform the connecting tube to clamp the conducting wire and the connection is reliable but cannot be disassembled without damage. Bolted connections also exist, such as the connection between a jumper wire clip or equipment wire clip and equipment, which are connected together with fasteners such as a bolt and nut, and which can be dissembled but are inconvenient to install and dissemble and the electrical contact is unreliable (because the bolt and nut may loosen).

In addition, the general plane-to-plane electric connection uses a tightened bolt method to maintain contact between the planes and larger planes often require multiple bolts, in which places closer to the bolt receive greater pressure and places farther away from the bolt receive less pressure, because the installation of the bolt onto the planes requires drilling a hole in the planes, which reduces the contact area. Therefore, this connection method has major defects.

CONTENT OF THE INVENTION

In order to overcome the shortcomings of prior electric connection methods in some specific applications, the present invention provides an electric connection method that has a simple structure and good clamping and is easy to install and disassemble.

The technical solution adopted with a view to implementing the above-mentioned objectives of the present invention is as follows: the electric connection method includes a metal element (1) with an axle socket and a metal element (2) with an axle head, wherein the cross section edges of the axle socket of the metal element (1) and the axle head of the metal element (2) are opposite asymptotic spiral lines. In this way, a structure is formed, where said axle head can be easily inserted at a certain angle into said axle socket along the axial center of the spiral line to form a hinge shape and leave a certain clearance; when the metal element with an axle head rotates in the asymptotic direction of the spiral line, the clearance between the axle head and the axle socket becomes smaller and smaller until it disappears; if the rotation continues, a compressive force will be generated between the axle head and the axle socket so that they are tightly combined to form a plane-to-plane, tight, unfailing contact face with a large contact area.

The neck area of said axle head is slightly narrower and the radian of said convex spiral line reaches 280 degrees or more.

The concave arc of said axle socket is 190 degrees or more.

Another form of structure of the present invention is that the other electric connection end of the metal element with an axle head is led out in the vertically axial direction of the axle head, and the axle socket of the metal element with an axle socket is in a closed-shape design; and its other electric connection end is designed to be in any direction except the direction of the other electric connection end of the metal element with an axle head.

From these characteristics we can see that the solution of the present invention has the following advantages as compared to the prior art:

1. The method of connection between the metal element 1 and the metal element 2 is a hinged connection of the axle socket and axle head, wherein the arc face of the axle socket is 190 degrees or more and the axle head cannot come out of the C-shaped opening of the axle socket.

2. The cross section edges of the axle socket and axle head are opposite asymptotic spiral lines, the axle head of the metal element 2 being easily inserted at a certain angle into the axle socket of the metal element 1 along the axial center of the spiral line to form a hinge shape and have a certain clearance.

3. When the metal element 2 rotates in the asymptotic direction of the spiral line, the clearance between the axle head and the axle socket is gradually reduced until it disappears; if the rotation continues, a compressive force will be generated between the axle head and the axle socket, causing slight outwards elastic deformation of the axle socket, so that a plane-to-plane, tight and unfailing contact with a large contact area is formed. The connection has low resistance and low temperature rise, and will not become loose easily and is maintenance free.

4. When the metal element 2 rotates against the asymptotic direction of the spiral line, clearance will appear between the axle head and axle socket; the axle head of the metal element 2 can be easily removed from the axle socket of the metal element 1 along the axial center of the spiral line.

We can see from the above description that in comparison with the prior art the electric connection of the present invention has a simple structure and deft design and is convenient and efficient to install and disassemble in addition to low resistance, low temperature rise, high current capability, good retention, resistance to loosening, safety in use and little maintenance. Furthermore, the contact between the two faces of the axle head and the axle socket is uniform, making it especially suitable for application in the electric contact field.

EMBODIMENTS

Figure 1:
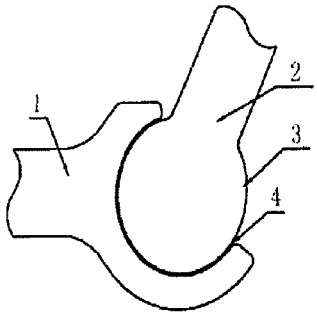
FIG. 1 is a front view of one embodiment of the present invention at the disconnected position, in which said axle head is inserted at a certain angle into said axle socket to form a hinge shape and leave a certain clearance.

The following will further describe the structure of the present invention in conjunction with the preferred embodiments as shown in the drawings.

Figure 2:
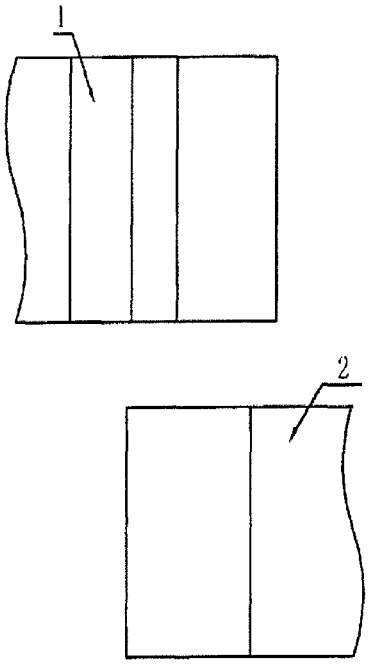
FIG. 2 is a plan view of the two metal elements in the embodiment shown in FIG. 1 when they are separated after being taken out in the axial direction of the axial center of the spiral line.

We can see from FIG. 1 and FIG. 2 that the present invention mainly comprises a metal element 1 with an axle socket and a metal element 2 with an axle head, wherein one side of the metal element 1 is the axle socket structure, and the cross section edge is a concave asymptotic spiral line; one side of the metal element 2 is the axle head structure, the cross section edge is the convex asymptotic spiral line 3 that is opposite the axle socket; the axle head of the metal element 2 can be easily inserted at a certain angle into the axle socket of the metal element 1 along the axial center of the spiral line to form a hinge shape and leave a certain clearance 4.

Figure 3:
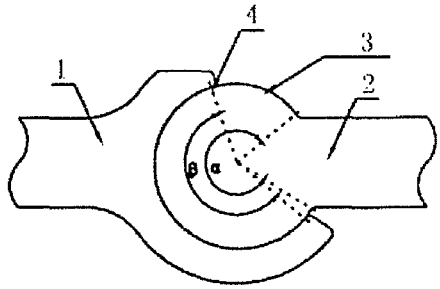
FIGS. 3 and 4 are the front view and the plan view of the embodiment shown in FIG. 1 when at the connection position.
Figure 4:
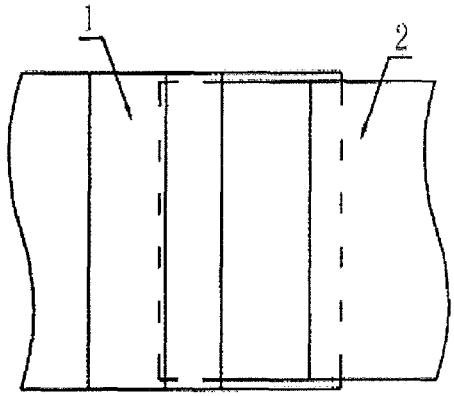
Figure 5:
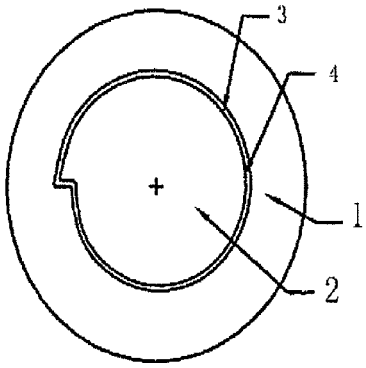
FIG. 5 is a front view of another embodiment of the present invention at the disconnected position, in which said axle head is inserted at a certain angle into said axle socket to form a hinge shape and leave a certain clearance.
Figure 7:
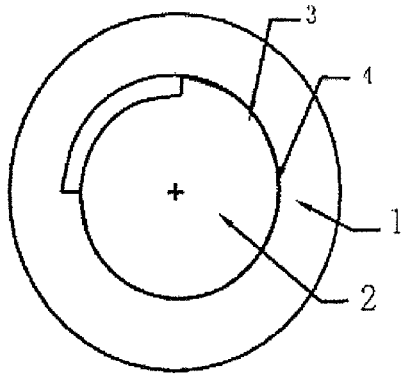
FIGS. 7 and 8 are the front view and the plan view of the embodiment shown in FIG. 5 at the position of inserting the connection.
Figure 6:
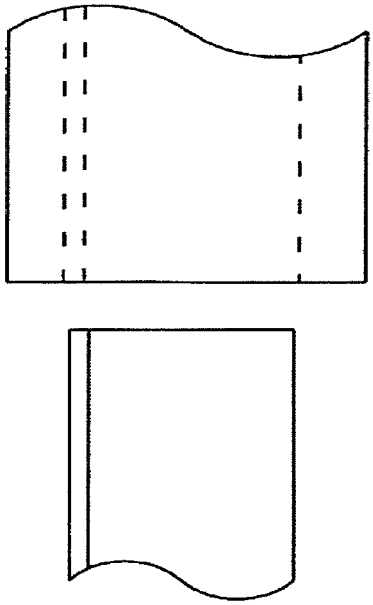
FIG. 6 is a plan view of the two metal elements in the embodiment shown in FIG. 5 when they are separated after being taken out along the axial center of the spiral line.
Figure 8:
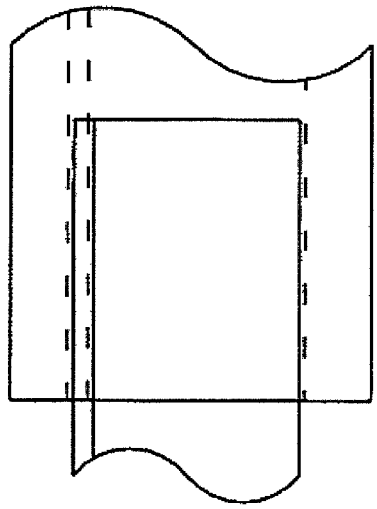

We can see from FIG. 3 and FIG. 4 that as the metal element 2 rotates along the asymptotic direction of the spiral line, the clearance between the axle head and the axle socket will be gradually reduced until it disappears; if the rotation continues, a compressive force will be generated between the axle head and the axle socket so that they are tightly combined to form a plane-to-plane, tight and unfailing contact with a large contact area. If it rotates in the opposite direction, clearance will be generated between the axle head and the axle socket, and the metal element 2 can be easily taken out along the axial center of the spiral line so as to achieve the objective of breaking the electric connection. The radian $\beta$ of the concave spiral line of the axle socket of the metal element 1 exceeds 190 degrees so that the axle head cannot come out of the C-shaped opening of the axle socket; the neck area of the axle head is slightly narrower so that the radian $\alpha$ of the convex spiral line reaches 280 degrees or more to allow a certain range of rotation of the axle head in the axle socket.

The detailed design of said axle head and axle socket can be based on the mathematical expression $R=r_0+a*\theta$ of the spiral line. In this formula, R is the radius of the spiral curve, $r_0$ is the radius at the starting point, a is asymptotic factor, and $\theta$ is angle. It is clear that the radius of the spiral curve will be asymptotically increased with the increase of the angle.

We can see from FIGS. 5 to 8 that, in another embodiment of the present invention, the other electric connection end of the metal element 2 is led out in the vertically axial direction of the axle head, and the axle socket of the metal element 1 is designed to be a closed-shape; and the other electric connection end of the metal element 1 is designed to be in any direction except the direction of the other electric connection end of the metal element 2.

The description only describes some of the preferred embodiments of the present invention and is not intended to limit the invention. Specialists skilled in the art can make various changes and modifications to the structure in accordance with the ideas and spirit of the present invention, for example, some fastening screws can be added according to the above-mentioned structural design to enhance the fixing strength. Therefore, these changes should also fall within the scope of protection of the present invention.

The invention claimed is:

1. An electric connection structure comprising a metal element with an axle socket and a metal element with an axle head, one side of the metal element with an axle socket being the axle socket structure and its cross section edge being a concave asymptotic spiral line; one side of the metal element with an axle head being the axle head structure and its cross section edge being a convex asymptotic spiral line that corresponds to the axle socket to form a structure so that said axle head can be easily inserted at a certain angle into said axle socket along the axial center of the spiral line to form a hinge shape and leave a certain clearance; when the metal element with an axle head rotates along the asymptotic direction of the spiral line, the clearance between the axle head and the axle socket will be gradually reduced until it disappears; if the rotation continues, a compressive force will be generated between the axle head and the axle socket so that they are tightly combined to form a plane-to-plane, tight, unfailing contact face with a large contact area.

2. The electric connection structure as claimed in claim 1, wherein the neck area of said axle head is slightly narrower and the radian of said convex spiral line reaches 280 degrees or more.

3. The electric connection structure as claimed in claim 1, wherein the concave arc of said axle socket is 190 degrees or more.

4. The electric connection structure as claimed in claim 1, wherein the other electric connection end of the metal element with an axle head is led out in the vertically axial direction of the axle head, and the axle socket of the metal element with an axle socket is designed to be a closed-shape; and its other electric connection end is designed to be in any direction except the direction of the other electric connection end of the metal element with an axle head.

* * * * *